US011389701B2

(12) United States Patent
Watanabe

(10) Patent No.: US 11,389,701 B2
(45) Date of Patent: Jul. 19, 2022

(54) GOLF BALL

(71) Applicant: Bridgestone Sports Co., Ltd., Tokyo (JP)

(72) Inventor: Hideo Watanabe, Saitamaken (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 17/087,810

(22) Filed: Nov. 3, 2020

(65) Prior Publication Data

US 2021/0170237 A1 Jun. 10, 2021

(30) Foreign Application Priority Data

Dec. 6, 2019 (JP) ..... JP2019-220909

(51) Int. Cl.
*A63B 37/06* (2006.01)
*A63B 37/00* (2006.01)

(52) U.S. Cl.
CPC ..... *A63B 37/0087* (2013.01); *A63B 37/0031* (2013.01); *A63B 37/0051* (2013.01); *A63B 37/0076* (2013.01); *A63B 37/00222* (2020.08); *A63B 37/00921* (2020.08); *A63B 37/0043* (2013.01); *A63B 37/0046* (2013.01)

(58) Field of Classification Search
CPC ..... A63B 37/0063; A63B 37/0062; A63B 37/0081
USPC ..... 473/376, 378
See application file for complete search history.

(56) References Cited

U.S. PATENT DOCUMENTS

| | | | | |
|---|---|---|---|---|
| 5,743,814 | A | 4/1998 | Endo | |
| 2011/0224024 | A1* | 9/2011 | Tutmark | A63B 37/0022 473/378 |
| 2014/0194221 | A1 | 7/2014 | Watanabe et al. | |
| 2015/0258388 | A1 | 9/2015 | Watanabe et al. | |
| 2016/0008667 | A1 | 1/2016 | Watanabe et al. | |
| 2016/0279484 | A1 | 9/2016 | Watanabe et al. | |
| 2017/0368419 | A1* | 12/2017 | Nakajima | A63B 37/0063 |

FOREIGN PATENT DOCUMENTS

| | | | |
|---|---|---|---|
| JP | 08-280845 | A | 10/1996 |
| JP | 2014-132955 | A | 7/2014 |
| JP | 2015-173860 | A | 10/2015 |
| JP | 2016-016117 | A | 2/2016 |
| JP | 2016-179052 | A | 10/2016 |

* cited by examiner

*Primary Examiner* — Raeann Gorden
(74) *Attorney, Agent, or Firm* — Sughrue Mion, PLLC

(57) ABSTRACT

A golf ball for amateur golfers is endowed with an excellent flight and a good feel at impact that is soft yet solid when hit by a golfer whose head speed is not very high. The ball, which includes a core and a cover, has a compressive deformation B when subjected to a final load of 30 kgf from an initial load state of 5 kgf that is from 0.72 to 0.97 mm and a compressive deformation C when subjected to a final load of 60 kgf from an initial load state of 5 kgf that is from 1.55 to 1.85 mm. In addition, the core has a hardness profile which satisfies specific conditions.

8 Claims, 2 Drawing Sheets

GOLF BALL

CROSS-REFERENCE TO RELATED APPLICATION

This non-provisional application claims priority under 35 U.S.C. § 119(a) on Patent Application No. 2019-220909 filed in Japan on Dec. 6, 2019, the entire contents of which are hereby incorporated by reference.

TECHNICAL FIELD

The present invention relates to a golf ball which has a core and a cover and is intended for use by amateur golfers whose head speed is not fast.

BACKGROUND ART

In the golf ball market for amateur golfers, numerous golf balls intended to satisfy amateur golfers in terms of flight performance and feel at impact have hitherto been developed. For example, JP-A H08-280845 describes a golf ball in which the amount of compressive deformation by the ball when subjected to a final load of 5 kgf from an initial load state of 0.2 kgf is used as an indicator of the effect on the ball properties when a small impact force acts upon the ball, this value being set in the range of from 0.26 to 0.40 mm. However, this golf ball is a spin-type ball that is targeted primarily at the spin on approach shots, and does not fully satisfy the flight performance desired on shots with a driver.

In addition, a variety of functional, multi-piece solid golf balls in which the ball has a multilayer construction and the surface hardnesses of the respective layers—i.e., the core, the envelope layer, the intermediate layer and the cover (outermost layer)—are optimized have been described. These include the multi-piece solid golf balls disclosed in JP-A 2014-132955, JP-A 2015-173860, JP-A 2016-16117 and JP-A 2016-179052. The golf balls disclosed in these patent publications are golf balls which satisfy the hardness relationship: ball surface harness>intermediate layer surface hardness>envelope layer surface hardness<core surface hardness, and which provide an excellent flight performance even when used by amateur golfers whose head speed is not fast. However, these prior-art golf balls do not optimize the amount of compressive deformation when subjected to a final load of 30 kgf from an initial load state of 5 kgf and the amount of compressive deformation when subjected to a final load of 60 kgf from an initial load state of 5 kgf. That is, no attention has been paid to how the golf ball properties are affected by the magnitude of the impact forces acting on the ball, and so there remains room for improvement in obtaining a good flight performance and a good feel at impact in golf ball products for amateur golfers.

SUMMARY OF THE INVENTION

It is therefore an object of the present invention to provide a golf ball for amateur golfers which has an excellent flight when hit by the average golfer whose head speed is not that high and which also has a good feel at impact that is soft yet solid.

As a result of extensive investigations, I have focused my attention on the relationship, in golf balls having a core and a cover, between the magnitude of the impact force that acts on the golf ball and the ball characteristics of flight performance and feel at impact. In doing so, I have discovered that, in the compressive deformation by the golf ball, by specifying the compressive deformation B when the ball is subjected to a final load of 30 kgf from an initial load state of 5 kgf and the compressive deformation C when the ball is subjected to a final load of 60 kgf from an initial load state of 5 kgf, and moreover by specifying the relationship between the respective Shore C hardnesses at the core center, the core surface and a position 3 mm inside the core surface, a flight performance that is satisfactory on shots with all types of golf clubs, including drivers (W #1) and irons, can be fully obtained by golfers whose head speed is not fast, in addition to which a feel at impact that is both soft and solid can be achieved.

Accordingly, in a first aspect, the invention provides a golf ball having a core and a cover, wherein the ball has an amount of compressive deformation such that the compressive deformation B when the ball is subjected to a final load of 30 kgf from an initial load state of 5 kgf is from 0.72 to 0.97 mm and the compressive deformation C when the ball is subjected to a final load of 60 kgf from an initial load state of 5 kgf is from 1.55 to 1.85 mm, and the core has a hardness profile which, letting Cs be the Shore C hardness at a surface of the core, Cs−3 be the Shore C hardness at a position 3 mm inside the core surface and Cc be the Shore C hardness at a center of the core, satisfies formulas (1) and (2) below.

$$Cs-Cc\geq 20 \quad (1)$$

$$Cs-Cs-3\leq 5.0 \quad (2)$$

In a preferred embodiment of the golf ball of the invention, the ball has an amount of compressive deformation such that the ratio D/C between compressive deformation C and the compressive deformation D when the ball is subjected to a final load of 130 kgf from an initial load state of 10 kgf is from 1.75 to 2.00.

In another preferred embodiment of the inventive golf ball, the ball has an amount of compressive deformation such that the ratio D/A between the compressive deformation D when the ball is subjected to a final load of 130 kgf from an initial load state of 10 kgf and the compressive deformation A when the ball is subjected to a final load of 5 kgf from an initial load state of 0.2 kgf is from 16.0 to 25.0.

In yet another preferred embodiment, the golf ball core is formed of a rubber composition which includes (a) a base rubber, (b) a co-crosslinking agent which is an α,β-unsaturated carboxylic acid or a metal salt thereof or both, (c) a crosslinking initiator and (d) a lower alcohol having a molecular weight of less than 200. In this preferred embodiment, the content of component (d) is preferably from 0.5 to 5 parts by weight per 100 parts by weight of the base rubber (a). Component (d) may be a monohydric, dihydric or trihydric alcohol. In particular, component (d) may be butanol, glycerol, ethylene glycol or propylene glycol.

In still another preferred embodiment, the golf ball further includes, between the core and the cover, at least an envelope layer and an intermediate layer, and has a construction of four or more layers that includes the core, the envelope layer, the intermediate layer and the cover.

In a further preferred embodiment, the golf ball cover has a coat formed on a surface thereof, which coat has a material hardness on the Shore C hardness scale of from 40 to 80.

Advantageous Effects of the Invention

The golf ball of the invention has an excellent flight performance when hit by golfers whose head speeds are not that high and also has a good feel at impact that is soft yet solid, making it well-suited for use by amateur golfers.

BRIEF DESCRIPTION OF THE DIAGRAMS

DESCRIPTION OF THE PREFERRED EMBODIMENTS

Figure 1:
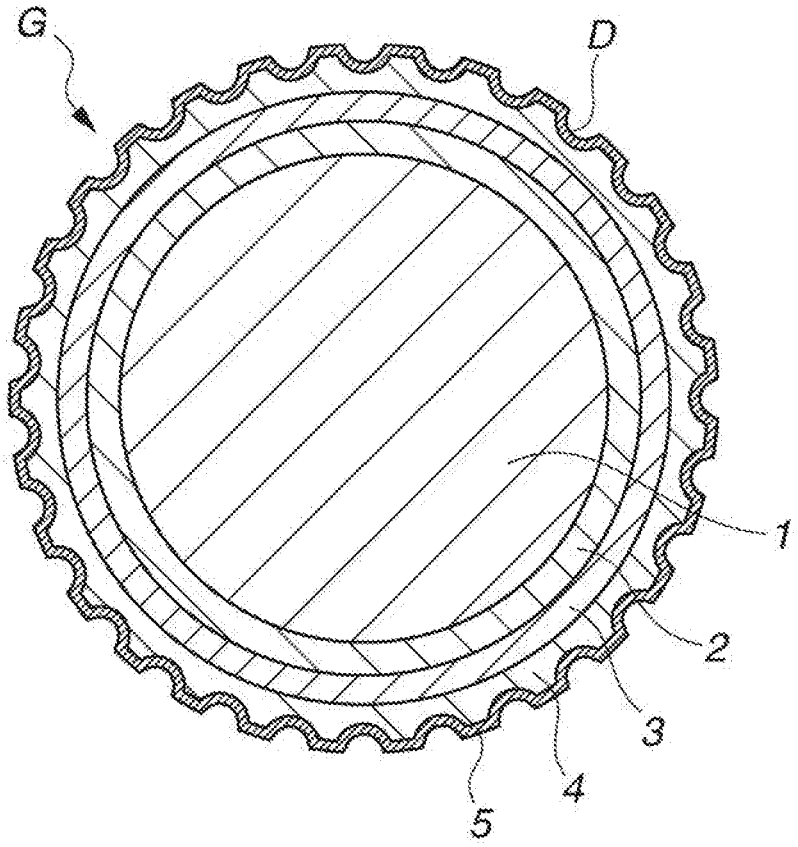
FIG. 1 is a schematic cross-sectional view of the golf ball (four-layer construction) according to one embodiment of the invention.

The objects, features and advantages of the invention will become more apparent from the following detailed description taken in conjunction with the appended diagrams.

The golf ball of the invention has a core and a cover. In this invention, the cover refers to the member positioned as the outermost layer in the ball construction, and generally is formed by molding, such as injection molding. Numerous dimples are typically formed on the outer surface of the cover at the same time that the cover material is injection molded. For example, referring to FIG. 1, the golf ball of the invention may be a multilayer golf ball G having four layers: a core 1, an envelope layer 2 encasing the core 1, an intermediate layer 3 encasing the envelope layer 2, and a cover 4 encasing the intermediate layer 3. Numerous dimples D are typically formed on the surface of the cover 4. In addition, a coat (coating layer) 5 obtained by painting is formed on the surface of the cover 4. Aside from the coat 5, the cover 4 is positioned as the outermost layer in the layered structure of the golf ball. The envelope layer 2, the intermediate layer 3 and the cover 4 are each not limited to a single layer and may be independently formed as a plurality of two or more layers. However, from the standpoint of mass productivity, it is preferable for the core to be made a single layer.

The core has a diameter of preferably at least 34.0 mm, more preferably at least 34.5 mm, and even more preferably at least 35.0 mm. The upper limit is preferably not more than 37.0 mm, more preferably not more than 36.5 mm, and even more preferably not more than 36.0 mm. When the core diameter is too small, the spin rate on shots with a driver (W #1) may become high, as a result of which it may not be possible to achieve the desired distance. On the other hand, when the core diameter is too large, the durability to repeated impact may worsen or the feel at impact may worsen.

The core has a compressive deformation (mm) when subjected to a final load of 1,275 N (130 kgf) from an initial load of 98 N (10 kgf) which, although not particularly limited, is preferably at least 3.0 mm, more preferably at least 3.5 mm, and even more preferably at least 4.0 mm. The upper limit is preferably not more than 7.0 mm, more preferably not more than 6.0 mm, and even more preferably not more than 5.0 mm. When this compressive deformation of the core is too small, i.e., when the core is too hard, the spin rate of the ball may rise excessively and a good distance may not be achieved, or the feel at impact may be too hard. On the other hand, when the compressive deformation of the core is too large, i.e., when the core is too soft, the ball rebound may be too low and a good distance may not be achieved, the feel at impact may be too soft, or the durability to cracking on repeated impact may worsen.

The core is formed of a rubber material, either as a single layer or as a plurality of layers. This core-forming rubber material is, specifically, a rubber composition that can be obtained by using a base rubber as the primary ingredient and compounding with this a co-crosslinking agent, an organic peroxide, an inert filler, an organosulfur compound and the like. In this invention, it is preferable to form the core of a rubber composition containing at least ingredients (a) to (d) below:

(a) a base rubber, (b) a co-crosslinking agent which is an α,β-unsaturated carboxylic acid and/or a metal salt thereof, (c) a crosslinking initiator, and (d) a lower alcohol having a molecular weight below 200.

It is preferable to use a polybutadiene as the base rubber serving as component (a). Commercial products may be used as the polybutadiene. Illustrative examples include BR01, BR51 and BR730 (all products of JSR Corporation). The proportion of polybutadiene within the base rubber is preferably at least 60 wt %, and more preferably at least 80 wt %. Rubber ingredients other than the above polybutadienes may be included in the base rubber, provided that doing so does not detract from the advantageous effects of the invention. Examples of rubber ingredients other than the above polybutadienes include other polybutadienes and other diene rubbers, such as styrene-butadiene rubbers, natural rubbers, isoprene rubbers and ethylene-propylene-diene rubbers.

The co-crosslinking agent serving as component (b) is an α,β-unsaturated carboxylic acid and/or a metal salt thereof. Specific examples of unsaturated carboxylic acids include acrylic acid, methacrylic acid, maleic acid and fumaric acid. The use of acrylic acid or methacrylic acid is especially preferred. Metal salts of unsaturated carboxylic acids are exemplified by the above unsaturated carboxylic acids which have been neutralized with a desired metal ion. Illustrative examples include the zinc salts and magnesium salts of methacrylic acid and acrylic acid. The use of zinc acrylate is especially preferred. The unsaturated carboxylic acid and/or metal salt thereof is included in an amount, per 100 parts by weight of the base rubber, which is preferably at least 10 parts by weight, more preferably at least 15 parts by weight, and even more preferably at least 20 parts by weight. The upper limit is preferably not more than 45 parts by weight, more preferably not more than 43 parts by weight, and even more preferably not more than 41 parts by weight.

It is desirable to use an organic peroxide as the crosslinking initiator serving as component (c). Specifically, the use of an organic peroxide having a relatively high thermal decomposition temperature is preferred. For example, an organic peroxide having an elevated one-minute half-life temperature of from about 165° C. to about 185° C., such as a dialkyl peroxide, may be used. Illustrative examples of dialkyl peroxides include dicumyl peroxide ("Percumyl D," from NOF Corporation), 2,5-dimethyl-2,5-di(t-butylperoxy) hexane ("Perhexa 25B," from NOF Corporation) and di(2-t-butylperoxyisopropyl)benzene ("Perbutyl P," from NOF Corporation). Preferred use can be made of dicumyl peroxide. These may be used singly or two or more may be used in combination. The half-life is one indicator of the organic peroxide decomposition rate, and is expressed as the time required for the original organic peroxide to decompose and the active oxygen content therein to fall to one-half. The vulcanization temperature for the core-forming rubber composition is generally in the range of 120° C. to 190° C. Within this range, the thermal decomposition of high-temperature organic peroxides having a one-minute half-life temperature of about 165° C. to about 185° C. is relatively slow. With the rubber composition of the invention, by regulating the amount of free radicals generated, which increases as the vulcanization time elapses, a crosslinked rubber core having a specific internal hardness profile is obtained.

The crosslinking initiator is included in an amount, per 100 parts by weight of the base rubber, of preferably at least 0.1 part by weight, more preferably at least 0.2 part by weight, and even more preferably at least 0.3 part by weight. The upper limit is preferably not more than 5.0 parts by weight, more preferably not more than 4.0 parts by weight, even more preferably not more than 3.0 parts by weight, and most preferably not more than 2.0 parts by weight. Including too much may make the core too hard, possibly resulting in an unpleasant feel at impact and greatly lowering the durability to cracking. On the other hand, when too little is included, the core may become too soft, possibly resulting in an unpleasant feel at impact and greatly lowering productivity.

Next, component (d) is a lower alcohol having a molecular weight of less than 200. As used herein, "alcohol" refers to a substance having one or more alcoholic hydroxyl group; substances obtained by the polycondensation of polyhydric alcohols having two or more hydroxyl groups are also included among such alcohols. Also, "lower alcohol" refers to an alcohol having a small number of carbon atoms; i.e., having a low molecular weight. By including this lower alcohol in the rubber composition, when the rubber composition is vulcanized (cured), a cured rubber product (core) having the desired core hardness profile can be obtained and a reduction in the spin rate of the ball on shots can be fully achieved, enabling the ball to have an excellent flight performance.

It is especially preferable for the lower alcohol to be a monohydric, dihydric or trihydric alcohol (an alcohol having one, two or three alcoholic hydroxyl groups). Specific examples include, but are not limited to, methanol, ethanol, propanol, butanol, ethylene glycol, diethylene glycol, propylene glycol, dipropylene glycol, tripropylene glycol and glycerol. These have molecular weights below 200, preferably below 150, and more preferably below 100. When the molecular weight is too large, i.e., when the number of carbons is too high, the desired core hardness profile may not be obtained or a reduced spin rate by the ball on shots may not be fully achievable.

The amount of component (d) included per 100 parts by weight of the base rubber serving as component (a) is preferably at least 0.1 part by weight, and more preferably at least 0.5 part by weight. The upper limit value is preferably not more than 10 parts by weight, more preferably not more than 6 parts by weight, and even more preferably not more than 3 parts by weight. When the amount of component (d) included is too high, the hardness may decrease and the desired feel, durability and rebound may not be obtained. When the amount included is too low, the desired core hardness profile may not be obtained and a reduction in the spin rate of the ball on shots may not be fully achievable.

Aside from above components (a) to (d), various other additives, such as fillers, antioxidants and organosulfur compounds, may be included, provided that doing so does not detract from the advantageous effects of the invention.

Fillers that may be suitably used include zinc oxide, barium sulfate and calcium carbonate. These may be used singly or two or more may be used in combination. The amount of filler included per 100 parts by weight of the base rubber may be set to preferably at least 1 part by weight, and more preferably at least 3 parts by weight. The upper limit in the amount included per 100 parts by weight of the base rubber may be set to preferably not more than 200 parts by weight, more preferably not more than 150 parts by weight, and even more preferably not more than 100 parts by weight. At a filler content which is too high or too low, a proper weight and a suitable rebound may be impossible to obtain.

Commercial products such as Nocrac NS-6, Nocrac NS-30 or Nocrac 200 (all products of Ouchi Shinko Chemical Industry Co., Ltd.) may be used as antioxidants. These may be used singly, or two or more may be used in combination.

The amount of antioxidant included per 100 parts by weight of the base rubber, although not particularly limited, is preferably at least 0.05 part by weight, and more preferably at least 0.1 part by weight. The upper limit is preferably not more than 1.0 part by weight, more preferably not more than 0.7 part by weight, and even more preferably not more than 0.4 part by weight. When the antioxidant content is too high or too low, a suitable core hardness gradient may not be obtained, as a result of which it may not be possible to obtain a good rebound, a good durability and a good spin rate-lowering effect on full shots.

In addition, an organosulfur compound may be included in the rubber composition so as to impart an excellent rebound. Thiophenols, thionaphthols, halogenated thiophenols, and metal salts thereof are recommended for this purpose. Illustrative examples include pentachlorothiophenol, pentafluorothiophenol, pentabromothiophenol, p-chlorothiophenol, and the zinc salt of pentachlorothiophenol; and also diphenylpolysulfides, dibenzylpolysulfides, dibenzoylpolysulfides, dibenzothiazoylpolysulfides and dithiobenzoylpolysulfides having 2 to 4 sulfurs. The use of diphenyldisulfide or the zinc salt of pentachlorothiophenol is especially preferred.

The amount of the organosulfur compound included per 100 parts by weight of the base rubber is at least 0.05 part by weight, preferably at least 0.07 part by weight, and more preferably at least 0.1 part by weight. The upper limit is not more than 5 parts by weight, preferably not more than 4 parts by weight, more preferably not more than 3 parts by weight, and most preferably not more than 2 parts by weight. Including too much organosulfur compound may excessively lower the hardness, whereas including too little is unlikely to improve the rebound.

Decomposition of the organic peroxide within the core formulation can be promoted by the direct addition of water (or a water-containing material) to the core material. It is known that the decomposition efficiency of the organic peroxide within the core-forming rubber composition changes with temperature and that, starting at a given temperature, the decomposition efficiency rises with increasing temperature. If the temperature is too high, the amount of decomposed radicals rises excessively, leading to recombination between radicals and, ultimately, deactivation. As a result, fewer radicals act effectively in crosslinking. Here, when a heat of decomposition is generated by decomposition of the organic peroxide at the time of core vulcanization, the vicinity of the core surface remains at substantially the same temperature as the temperature of the vulcanization mold, but the temperature near the core center, due to the build-up of heat of decomposition by the organic peroxide which has decomposed from the outside, becomes considerably higher than the mold temperature. In cases where water (or a water-containing material) is added directly to the core, because the water acts to promote decomposition of the organic peroxide, radical reactions like those described above can be made to differ at the core center and the core surface. That is, decomposition of the organic peroxide is further promoted near the center of the core, bringing about greater radical deactivation, which leads to a further decrease in the amount of active radicals. As a result, it is possible to obtain a core in which the crosslink densities at the core center and the core surface differ markedly. It is also possible to obtain a core having different dynamic viscoelastic properties at the core center.

Along with achieving a lower spin rate, golf balls having such a core also exhibit an excellent durability and undergo little change over time in rebound.

The water included in the core material is not particularly limited, and may be distilled water or tap water. The use of distilled water which is free of impurities is especially preferred. The amount of water included per 100 parts by weight of the base rubber is preferably at least 0.1 part by weight, and more preferably at least 0.3 part by weight. The upper limit is preferably not more than 5 parts by weight, and more preferably not more than 4 parts by weight.

By including a suitable amount of such water, the moisture content in the rubber composition prior to vulcanization becomes preferably at least 1,000 ppm, and more preferably at least 1,500 ppm. The upper limit is preferably not more than 8,500 ppm, and more preferably not more than 8,000 ppm. When the moisture content of the rubber composition is too low, it may be difficult to obtain a suitable crosslink density and tan 6, which may make it difficult to mold a golf ball having little energy loss and a reduced spin rate. On the other hand, when the moisture content of the rubber composition is too high, the core may end up too soft, which may make it difficult to obtain a suitable core initial velocity.

The core can be produced by vulcanizing/curing the rubber composition containing the above ingredients. For example, production may be carried out by kneading the composition using a mixer such as a Banbury mixer or a roll mill, compression molding or injection molding the kneaded composition using a core mold, and curing the molded material by suitably heating it at a temperature sufficient for the organic peroxide or co-crosslinking agent to act, i.e., between 100° C. and 200° C., preferably between 140° C. and 180° C., for 10 to 40 minutes.

Next, the core hardness profile is described.

The core has a center hardness (Cc) which, expressed on the Shore C hardness scale, is preferably at least 47, more preferably at least 49, and even more preferably at least 51. The upper limit is preferably not more than 60, more preferably not more than 57, and even more preferably not more than 55. When this value is too large, the feel at impact may become hard, or the spin rate on full shots may rise, as a result of which the intended distance may not be achieved. On the other hand, when this value is too small, the rebound may be low, resulting in a poor distance, or the durability to cracking on repeated impact may worsen. The Shore C hardness is the hardness value measured with a Shore C durometer in general accordance with ASTM D2240.

The core center hardness (Cc) on the Shore D hardness scale is preferably at least 25, more preferably at least 26, and even more preferably at least 28. The upper limit is preferably not more than 36, more preferably not more than 33, and even more preferably not more than 32.

The core has a surface hardness (Cs) which, expressed on the Shore C hardness scale, is preferably at least 68, more preferably at least 70, and even more preferably at least 72. The upper limit is preferably not more than 83, more preferably not more than 80, and even more preferably not more than 77. A value outside of this range may lead to undesirable results similar to those described above for the core center hardness (Cc).

The core surface hardness (Cc) on the Shore D hardness scale is preferably at least 37, more preferably at least 38, and even more preferably at least 40. The upper limit is preferably not more than 48, more preferably not more than 46, and even more preferably not more than 44.

The difference between the core surface hardness (Cs) and the core center hardness (Cc), expressed on the Shore C hardness scale, must be at least 20 and is preferably at least 21, and even more preferably at least 22. The upper limit is preferably not more than 30, more preferably not more than 25, and even more preferably not more than 23. When this value is too small, the ball spin rate-lowering effect on full shots is inadequate, resulting in a poor distance. When this value is too large, the initial velocity of the ball when struck may decrease, resulting in a poor distance, or the durability to cracking on repeated impact may worsen.

In this invention, letting Cs−3 be the Shore C hardness at a position 3 mm inside the core surface, the golf ball must satisfy the following condition.

$$Cs-Cs-3 \leq 5.0 \quad (2)$$

By thus optimizing the difference between the core surface hardness (Cs) and the hardness at a given position of the core (Cs−3), the spin rate on full shots can be reduced, enabling an increased distance to be achieved, in addition to which a good durability to cracking is obtained. In above formula (2), the upper limit value of Cs−Cs−3, expressed in terms of Shore C hardness, is 5 or less, preferably 4 or less, and more preferably 3 or less. Also, in formula (2), the lower limit value of Cs−Cs−3 is preferably 0 or more, more preferably 1 or more, and even more preferably 2 or more. When the value of Cs−Cs−3 is too small, the spin rate-lowering effect on full shots may be inadequate, resulting in a poor distance. On the other hand, when this value is too large, the durability to cracking on repeated impact worsens.

The Shore C hardness at a position 3 mm inside the core surface (Cs−3) is preferably at least 66, more preferably at least 68, and even more preferably at least 70. The upper limit value is preferably not more than 80, more preferably not more than 77, and even more preferably not more than 74. When this value is too large, the feel at impact may become hard or the spin rate on full shots may rise, as a result of which the desired distance may not be obtained. On the other hand, when this value is too small, the rebound may become low, resulting in a poor distance, or the durability to cracking on repeated impact may worsen.

Next, the cover serving as outermost layer of the golf ball is described.

The cover has a material hardness on the Shore D hardness scale which, although not particularly limited, is preferably at least 55, more preferably at least 59, and even more preferably at least 61. The upper limit is preferably not more than 70, more preferably not more than 68, and even more preferably not more than 65. The cover surface hardness (also referred to as the "ball surface hardness") on the Shore D hardness scale is preferably at least 61, more preferably at least 65, and even more preferably at least 67. The upper limit is preferably not more than 76, more preferably not more than 74, and even more preferably not more than 71. When the cover material hardness and the ball surface hardness are softer than the above ranges, the spin rate may rise on shots with a driver (W #1) and the initial velocity of the ball may decrease, possibly resulting in a poor distance. When the material hardness and surface hardness are too high, the durability to cracking on repeated impact may worsen.

The cover has a thickness of preferably at least 0.6 mm, more preferably at least 0.8 mm, and even more preferably at least 1.1 mm. The upper limit in the cover thickness is preferably 1.5 mm or less, more preferably 1.4 mm or less, and even more preferably 1.3 mm or less. When the cover is too thin, the durability to cracking on repeated impact may worsen. On the other hand, when the cover is too thick, the spin rate on shots with a driver (W #1) may rise excessively, resulting in a poor distance, or the feel at impact in the short game and on shots with a putter may be too hard.

Various types of thermoplastic resins, especially ionomeric resins, that are used as golf ball cover materials may be suitably used as the cover material. A commercial product may be used as the ionomeric resin. Alternatively, the cover-forming resin material used may be one obtained by blending, of commercially available ionomeric resins, a high-acid ionomeric resin having an acid content of at least 18 wt % with an ordinary ionomeric resin. The high rebound and spin rate-lowering effect obtained with such a blend make it possible to achieve a good distance on shots with a driver (W #1). The amount of high-acid ionomeric resin per 100 wt % of the resin material is preferably at least 10 wt %, more preferably at least 30 wt %, and even more preferably at least 60 wt %. The upper limit is generally 100 wt %, preferably 90 wt % or less, and more preferably 80 wt % or less. When the content of this high-acid ionomeric resin is too low, the spin rate on shots with a driver (W #1) may rise, as a result of which a good distance may not be achieved. On the other hand, when the content of this high-acid ionomeric resin is too high, the durability to cracking on repeated impact may worsen.

The envelope layer and intermediate layer described below may be provided between the above core and the above cover. That is, the preferred ball construction in this invention is not limited to a two-piece golf ball having a core and a single-layer cover; a three-piece or four-piece golf ball construction may also be employed. It is especially preferable for the golf ball to be provided with a four-layer construction having a core, an envelope layer, an intermediate layer and a cover. The golf ball G shown in FIG. 1 is an example of such a golf ball. This golf ball G in FIG. 1 has a core 1, an envelope layer 2 encasing the core 1, an intermediate layer 3 encasing the envelope layer 2, and a cover 4 encasing the intermediate layer 3. Aside from a coating layer, this cover 4 is positioned as the outermost layer in the layer construction of the golf ball. The intermediate layer, envelope layer and cover may each be independently formed of a single layer or of two or more layers. Numerous dimples D are generally formed on the surface of the cover (outermost layer) 4 in order to enhance the aerodynamic properties of the ball. In addition, a coating layer 5 is formed on the surface of the cover 4.

Next, the envelope layer is described.

The envelope layer has a material hardness on the Shore D scale which, although not particularly limited, is preferably at least 20, more preferably at least 23, and even more preferably at least 27. The upper limit is preferably not more than 45, more preferably not more than 42, and even more preferably not more than 40. The sphere obtained by encasing the core with the envelope layer (envelope layer-encased sphere) has a surface hardness on the Shore D scale which is preferably at least 28, more preferably at least 31, and even more preferably at least 35. The upper limit is preferably not more than 53, more preferably not more than 50, and even more preferably not more than 48. When the material hardness and surface hardness of the envelope layer are lower than the above ranges, the spin rate of the ball on full shots may rise excessively and a good distance may not be achieved, or the durability to cracking on repeated impact may worsen. On the other hand, when the material hardness and surface hardness are too high, the durability to cracking on repeated impact may worsen or the spin rate on full shots may rise and, at low head speeds in particular, a good distance may not be obtained. Also, the feel at impact may worsen.

The envelope layer has a thickness which is preferably at least 0.7 mm, more preferably at least 0.9 mm, and even more preferably at least 1.1 mm. The upper limit in the thickness of the envelope layer is preferably not more than 1.5 mm, more preferably not more than 1.4 mm, and even more preferably not more than 1.3 mm. When the envelope layer is too thin, the durability to cracking on repeated impact may worsen or the feel at impact may worsen. On the other hand, when the envelope layer is too thick, the spin rate of the ball on full shots may increase and a good distance may not be obtained.

The envelope layer material is not particularly limited, although various thermoplastic resin materials may be suitably used. Specifically, use can be made of ionomeric resins and of urethane-, amide-, ester-, olefin- or styrene-based thermoplastic elastomers, as well as mixtures thereof. In particular, to obtain a good rebound in the desired hardness range, the use of a thermoplastic polyether ester elastomer is preferred.

The sphere obtained by encasing the core with the envelope layer (envelope layer-encased sphere) has a compressive deformation (mm) when subjected to a final load of 1,275 N (130 kgf) from an initial load state of 98 N (10 kgf) which, although not particularly limited, is preferably at least 3.4 mm, more preferably at least 3.8 mm, and even more preferably at least 3.9 mm. The upper limit is preferably not more than 4.7 mm, more preferably not more than 4.5 mm, and even more preferably not more than 4.3 mm. When the compressive deformation of this sphere is too small, i.e., when the sphere is too hard, the spin rate of the ball may rise excessively, resulting in a poor distance, or the feel at impact may be too hard. On the other hand, when the compressive deformation of this sphere is too large, i.e., when the sphere is too soft, the ball rebound may be too low, resulting in a poor distance, the feel at impact may be too soft, or the durability to cracking on repeated impact may worsen.

Next, the intermediate layer is described.

The intermediate layer has a material hardness on the Shore D scale which, although not particularly limited, is preferably at least 40, more preferably at least 45, and even more preferably at least 50. The upper limit is preferably not more than 62, more preferably not more than 60, and even more preferably not more than 58. The sphere obtained by encasing the envelope layer-encased sphere with the intermediate layer (intermediate layer-encased sphere) has a surface hardness on the Shore D scale which is preferably at least 46, more preferably at least 51, and even more preferably at least 56. The upper limit is preferably not more than 68, more preferably not more than 66, and even more preferably not more than 64. When the material hardness and surface hardness of the intermediate layer are lower than the above ranges, the spin rate of the ball on full shots may rise excessively, as a result of which a good distance may not be achieved, or the durability to cracking on repeated impact may worsen. On the other hand, when the material hardness and surface hardness are too high, the durability to cracking on repeated impact may worsen or the feel at impact may worsen.

The intermediate layer has a thickness which is preferably at least 0.7 mm, more preferably at least 0.9 mm, and even more preferably at least 1.1 mm. The upper limit in the thickness of the intermediate layer is preferably not more than 1.5 mm, more preferably not more than 1.4 mm, and even more preferably not more than 1.35 mm. When the intermediate layer is thinner than the above range, the durability to cracking on repeated impact may worsen or the feel at impact may worsen. On the other hand, when the intermediate layer is thicker than this range, the spin rate of the ball on full shots may increase and a good distance may not be obtained.

The material making up the intermediate layer is not particularly limited; a known resin may be used for this purpose. Examples of preferred materials include resin compositions containing as the essential ingredients:

100 parts by weight of a resin component composed of, in admixture, (A) a base resin of (a-1) an olefin-unsaturated carboxylic acid random copolymer and/or a metal ion neutralization product of an olefin-unsaturated carboxylic acid random copolymer mixed with (a-2) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (B) a non-ionomeric thermoplastic elastomer in a weight ratio between 100:0 and 50:50;

(C) from 5 to 100 parts by weight of a fatty acid and/or fatty acid derivative having a molecular weight of from 228 to 1,500; and (D) from 0.1 to 17 parts by weight of a basic inorganic metal compound capable of neutralizing un-neutralized acid groups in components A and C.

Components A to D in the intermediate layer-forming resin material described in, for example, JP-A 2010-253268 may be advantageously used as above components A to D.

A non-ionomeric thermoplastic elastomer may be included in the intermediate layer material. The non-ionomeric thermoplastic elastomer is preferably included in an amount of from 0 to 50 parts by weight per 100 parts by weight of the total amount of the base resin.

Exemplary non-ionomeric thermoplastic elastomers include polyolefin elastomers (including polyolefins and metallocene polyolefins), polystyrene elastomers, diene polymers, polyacrylate polymers, polyamide elastomers, polyurethane elastomers, polyester elastomers and polyacetals.

Depending on the intended use, optional additives may be suitably included in the intermediate layer material. For example, pigments, dispersants, antioxidants, ultraviolet absorbers and light stabilizers may be added. When these additives are included, the amount added per 100 parts by weight of the overall base resin is preferably at least 0.1 part by weight, and more preferably at least 0.5 part by weight. The upper limit is preferably not more than 10 parts by weight, and more preferably not more than 4 parts by weight.

The sphere obtained by encasing the envelope layer-encased sphere with the intermediate layer (intermediate layer-encased sphere) has a compressive deformation (mm) when subjected to a final load of 1,275 N (130 kgf) from an initial load state of 98 N (10 kgf) which, although not particularly limited, is preferably at least 3.3 mm, more preferably at least 3.45 mm, and even more preferably at least 3.6 mm. The upper limit is preferably not more than 4.2 mm, more preferably not more than 4.0 mm, and even more preferably not more than 3.8 mm. When the compressive deformation of this sphere is too small, i.e., when the sphere is too hard, the spin rate of the ball may rise excessively, resulting in a poor distance, or the feel at impact may be too hard. On the other hand, when the compressive deformation of this sphere is too large, i.e., when the sphere is too soft, the ball rebound may be too low, resulting in a poor distance, the feel at impact may be too soft, or the durability to cracking on repeated impact may worsen.

The manufacture of multi-piece solid golf balls in which the above-described core, envelope layer, intermediate layer and cover (outermost layer) are formed as successive layers may be carried out by a customary method such as a known injection-molding process. For example, a multi-piece golf ball can be obtained by successively injection-molding the respective materials for the envelope layer and the intermediate layer over the core so as to obtain an intermediate layer-encased sphere, and then injection-molding over this the cover material. Alternatively, the golf ball can be manufactured by, for each encasing layer, enclosing the sphere to be encased within two half-cups that have been pre-molded into hemispherical shapes as the encasing layer and then molding under applied heat and pressure.

The golf ball of the invention has a compressive deformation A when subjected to a final load of 5 kgf from an initial load state of 0.2 kgf which is preferably not more than 0.21 mm, more preferably not more than 0.19 mm, and even more preferably not more than 0.17 mm. The lower limit is preferably at least 0.10 mm, and more preferably at least 0.12 mm. When this value is too small, in cases where this is due to the cover hardness, the cover may be too hard and the durability to cracking on repeated impact may worsen. In cases where this small value is due to the hardness or thickness (diameter) of the intermediate layer, the envelope layer and the core, the feel of the ball at impact on full shots may become too hard. On the other hand, when this value is too large, in cases where this is due to the cover hardness, the spin rate of the ball on full shots may end up rising and a good distance may not be obtained. In cases where this large value is due to the hardness or thickness (diameter) of the intermediate layer, the envelope layer and the core, the crisp feel of the ball on full shots may be lost and a good distance may not be achieved.

The golf ball of the invention has a compressive deformation B when subjected to a final load of 30 kgf from an initial load state of 5 kgf which is at least 0.72 mm, preferably at least 0.73 mm, and more preferably at least 0.74 mm. The upper limit is not more than 0.97 mm, preferably not more than 0.90 mm, and more preferably not more than 0.86 mm. When this value is too small, the feel of the ball on shots with a utility club (UT) or an iron is too hard. On the other hand, when this value is too large, the crisp feel of the ball on shots with a utility club (UT) or an iron diminishes and a good distance is not obtained.

The golf ball of the invention has a compressive deformation C when subjected to a final load of 60 kgf from an initial load state of 5 kgf which is at least 1.55 mm, preferably at least 1.56 mm, and more preferably at least 1.58 mm. The upper limit is not more than 1.85 mm, preferably not more than 1.83 mm, and more preferably not more than 1.81 mm. When this value is too small, the feel of the ball on shots with a utility club (UT) or an iron is too hard. On the other hand, when this value is too large, the crisp feel of the ball on shots with a utility club (UT) or an iron diminishes and a good distance is not obtained.

The golf ball of the invention has a compressive deformation D when subjected to a final load of 130 kgf from an initial load state of 10 kgf which is preferably at least 2.80 mm, more preferably at least 2.90 mm, and even more preferably at least 2.95 mm. The upper limit is preferably not more than 3.40 mm, more preferably not more than 3.30 mm, and even more preferably not more than 3.25 mm. When this value is too small, the spin rate of the ball may end up rising, resulting in a poor distance, or the feel at impact may be too hard. On the other hand, when this value is too large, the ball rebound may be too low, resulting in a poor distance, the feel at impact may be too soft, or the durability to cracking on repeated impact may worsen.

The ratio D/C of compressive deformation D to compressive deformation C is preferably at least 1.75, more preferably at least 1.77, and even more preferably at least 1.79. This ratio has an upper limit which is preferably not more than 2.00, more preferably not more than 1.95, and even more preferably not more than 1.90. Outside of this range, the ball may be too receptive to spin or the initial velocity of the ball on shots may decrease, which may, depending on the club number, result in a loss of distance.

The ratio D/B of compressive deformation D to compressive deformation B is preferably at least 3.65, more preferably at least 3.67, and even more preferably at least 3.69. This ratio has an upper limit which is preferably not more than 4.20, more preferably not more than 4.15, and even more preferably not more than 4.10. Outside of this range, the ball may be too receptive to spin or the initial velocity of the ball on shots may decrease, which may, depending on the club number, result in a loss of distance.

The ratio D/A of compressive deformation D to compressive deformation A is preferably at least 16.0, more preferably at least 17.0, and even more preferably at least 17.5. This ratio has an upper limit which is preferably not more than 25.0, more preferably not more than 24.0, and even more preferably not more than 23.5. Outside of this range, the ball may be too receptive to spin or the initial velocity of the ball on shots may decrease, which may, depending on the club number, result in a loss of distance.

Surface Hardness Relationships Among Layers

It is preferable for the surface hardness of the envelope layer to be higher than the core center hardness. The value obtained by subtracting the core center hardness from the envelope layer surface hardness (envelope layer surface hardness−core center hardness), expressed on the Shore D hardness scale, is preferably from 3 to 23, more preferably from 5 to 20, and even more preferably from 7 to 17. Also, the value obtained by subtracting the core surface hardness from the envelope layer surface hardness (envelope layer surface hardness−core surface hardness), expressed on the Shore D hardness scale, is preferably from −15 to 15, more preferably from −10 to 10, and even more preferably from −5 to 5. When these values are too small, the spin rate of the ball on full shots may rise and a good distance may not be achieved. On the other hand, when these values are too large, the feel at impact may worsen or the durability to cracking on repeated impact may worsen.

It is preferable for the surface hardness of the intermediate layer to be higher than the surface hardness of the envelope layer. The value obtained by subtracting the envelope layer surface hardness from the intermediate layer surface hardness (intermediate layer surface hardness−envelope layer surface hardness), expressed on the Shore D hardness scale, is preferably from 13 to 28, more preferably from 15 to 26, and even more preferably from 17 to 24. When this value is too small, the spin rate of the ball on full shots may rise and a good distance may not be achieved. On the other hand, when this value is too large, the feel at impact may worsen or the durability to cracking on repeated impact may worsen.

The value obtained by subtracting the ball surface hardness from the core surface hardness (core surface hardness−ball surface hardness), expressed on the Shore D hardness scale, is preferably form −40 to −10, more preferably form −35 to −14, and even more preferably from −30 to −20. When this value is too small, the solid feel may be lost or the durability to cracking on repeated impact may worsen. On the other hand, when this value is too large, the spin rate of the ball may rise and a good distance may not be achieved.

It is preferable for the surface hardness of the ball to be higher than the surface hardness of the intermediate layer. The value obtained by subtracting the intermediate layer surface hardness from the ball surface hardness (ball surface hardness−intermediate layer surface hardness), expressed on the Shore D hardness scale, is preferably from 1 to 14, more preferably from 3 to 10, and even more preferably from 5 to 8. When this value is too small, the spin rate of the ball on full shots may rise and a good distance may not be achieved. On the other hand, when this value is too large, the feel at impact may worsen or the durability to cracking on repeated impact may worsen.

Compressive Deformation Relationships Among Encased Spheres

Letting the compressive deformations (mm) of the core and the envelope layer-encased sphere when these spheres are subjected to a final load of 1,275 N (130 kgf) from an initial load state of 98 N (10 kgf) be respectively P and Q, the value P−Q is preferably from 0 to 0.6 mm, more preferably from 0.1 to 0.5 mm, and even more preferably from 0.2 to 0.4 mm. When this value is too small, the feel at impact may be poor or the durability to cracking on repeated impact may worsen. On the other hand, when this value is too large, the spin rate of the ball on full shots may rise and a good distance may not be achieved.

Letting the compressive deformations (mm) of the envelope layer-encased sphere and the intermediate layer-encased sphere when these spheres are subjected to a final load of 1,275 N (130 kgf) from an initial load state of 98 N (10 kgf) be respectively Q and R, the value Q−R is preferably from 0.1 to 0.8 mm, more preferably from 0.2 to 0.7 mm, and even more preferably from 0.3 to 0.6 mm. When this value is too small, the spin rate of the ball on full shots may rise and a good distance may not be achieved. On the other hand, when this value is too large, the feel at impact may worsen or the durability to cracking on repeated impact may worsen.

Letting the compressive deformations (mm) of the core and the ball when these spheres are subjected to a final load of 1,275 N (130 kgf) from an initial load state of 98 N (10 kgf) be respectively P and D, the value P−D is preferably from 1.0 to 1.7 mm, more preferably from 1.1 to 1.6 mm, and even more preferably from 1.2 to 1.5 mm. When this value is too small, the spin rate of the ball on full shots may rise and a good distance may not be achieved. On the other hand, when this value is too large, a solid feel at impact may be lost or the durability to cracking on repeated impact may worsen.

Numerous dimples may be formed on the outside surface of the cover serving as the outermost layer. The number of dimples arranged on the cover surface, although not particularly limited, is preferably at least 250, more preferably at least 300, and even more preferably at least 320. The upper limit is preferably not more than 440, more preferably not more than 400, and even more preferably not more than 360. When the number of dimples is higher than this range, the ball trajectory may become lower and the distance traveled by the ball may decrease. On the other hand, when the number of dimples is lower that this range, the ball trajectory may become higher and a good distance may not be achieved. The arrangement of these dimples may have symmetry that follows a tetrahedral, octahedral, dodecahedral or other polyhedral/polygonal shape, or may have rotational symmetry along an axis connecting the poles of the ball.

It is recommended that preferably two or more dimple types, and more preferably three or more dimple types, of mutually differing diameter and/or depth be formed. With regard to the planar shapes of the dimples, a single dimple shape or a combination of two or more dimple shapes, such as circular shapes, various polygonal shapes, dewdrop shapes and oval shapes, may be suitably used. For example, when circular dimples are used, the dimple diameter may be set to at least about 2.5 mm and up to about 6.5 mm, and the dimple depth may be set to at least 0.07 mm and up to 0.30 mm. The cross-sectional shapes of the dimples may be defined as one or a combination of two or more types, including arcuate shapes, conical shapes, flat-bottomed shapes and curves expressed by various functions, and may have, other than near the dimple edges, a plurality of inflection points.

In order for the aerodynamic properties to be fully manifested, it is desirable for the dimple coverage ratio, i.e., the dimple surface coverage SR, which is the collective surface area of the imaginary spherical surfaces circumscribed by the edges of the individual dimples, as a percentage of the spherical surface area of the golf ball, to be set to at least 70% and not more than 90%. Also, to optimize the ball trajectory, it is desirable for the value $V_0$, defined as the spatial volume of the individual dimples below the flat plane circumscribed by the dimple
edge, divided by the volume of the cylinder whose base is the flat plane and whose height is the maximum depth of the dimple from the base, to be set to at least 0.35 and not more than 0.80. Moreover, it is preferable for the ratio VR of the sum of the volumes of the individual dimples, each formed below the flat plane circumscribed by the edge of the dimple, with respect to the volume of the ball sphere were the ball to have no dimples on its surface, to be set to at least 0.6% and not more than 1.0%. Outside of the above ranges in these respective values, the resulting trajectory may not enable a good distance to be achieved and so the ball may fail to travel a fully satisfactory distance. Also, in order to satisfy the rule for symmetry of the ball's carry, dimple volumes near the poles may be made smaller and dimple volumes near the equator may be made larger than the volumes of dimples away from the poles and the equator.

A clear coating is preferably applied to the surface of the cover, in part to ensure a good appearance. Coating compositions that may be employed in clear coating preferably use two types of polyester polyol as the base resin and, together with this, a polyisocyanate as the curing agent. Depending on the coating conditions, various types of organic solvents may be mixed into the coating composition. Examples of such organic solvents include aromatic solvents such as toluene, xylene and ethylbenzene; ester solvents such as ethyl acetate, butyl acetate, propylene glycol methyl ether acetate and propylene glycol methyl ether propionate; ketone solvents such as acetone, methyl ethyl ketone, methyl isobutyl ketone and cyclohexanone; ether solvents such as diethylene glycol dimethyl ether, diethylene glycol diethyl ether and dipropylene glycol dimethyl ether; alicyclic hydrocarbon solvents such as cyclohexane, methyl cyclohexane and ethyl cyclohexane; and petroleum hydrocarbon solvents such as mineral spirits.

The coat (coating layer) obtained by clear coating has a hardness, expressed on the Shore C hardness scale, of preferably from 40 to 80, more preferably from 47 to 72, and even more preferably from 55 to 65. If this coat is too soft, mud may tend to adhere to the ball surface when the ball is used to play golf. On the other hand, if the coat is too hard, it may tend to crack and peel when the ball is hit.

The value obtained by subtracting the material hardness of the coat from the material hardness of the cover, expressed on the Shore C hardness scale, is preferably from 10 to 50, more preferably from 20 to 40, and even more preferably from 25 to 35. If this value is larger than the above numerical range, mud tends to adhere to the ball surface when the ball is used to play golf. On the other hand, if this value is smaller than the above numerical range, the coat may tend to crack and peel when the ball is hit.

The coat (coating layer) has a thickness which is typically from 9 to 22 μm, preferably from 11 to 20 μm, and more preferably from 13 to 18 μm.

The multi-piece solid golf ball of the invention can be made to conform to the Rules of Golf for play. The inventive ball may be formed to a diameter which is such that the ball does not pass through a ring having an inner diameter of 42.672 mm and is not more than 42.80 mm, and to a weight which is preferably between 45.0 and 45.93 g.

EXAMPLES

The following Examples and Comparative Examples are provided to illustrate the invention, and are not intended to limit the scope thereof.

Examples 1 to 6, Comparative Examples 1 to 6

Formation of Core

Solid cores were produced by preparing rubber compositions for the respective Examples and Comparative Examples shown in Table 1, and then molding and vulcanizing the compositions under vulcanization conditions of 155° C. and 15 minutes. It is noted that in Example 2 and Comparative Examples 4, 5, 6, the core-forming rubber composition formulated as shown in Table 1 is prepared and then molded and vulcanized as described above.

TABLE 1

| Core formulation | Example | | | | | | Comparative Example | | | | | |
|---|---|---|---|---|---|---|---|---|---|---|---|---|
| (content: pbw) | 1 | 2 | 3 | 4 | 5 | 6 | 1 | 2 | 3 | 4 | 5 | 6 |
| Polybutadiene A | 100 | 100 | 100 | 100 | 100 | 100 | 100 | 100 | 100 | 80 | 80 | 100 |
| Polybutadiene B | | | | | | | | | | 20 | 20 | |
| Zinc acrylate (1) | 29.0 | 26.9 | 27.8 | 30.3 | 29.0 | 29.0 | 30.3 | 31.6 | 30.3 | 25.8 | | 40.3 |
| Zinc acrylate (2) | | | | | | | | | | | 29.6 | |

TABLE 1-continued

| Core formulation | Example | | | | | | Comparative Example | | | | | |
|---|---|---|---|---|---|---|---|---|---|---|---|---|
| (content: pbw) | 1 | 2 | 3 | 4 | 5 | 6 | 1 | 2 | 3 | 4 | 5 | 6 |
| Organic peroxide (1) | 0.5 | 0.5 | 0.5 | 0.5 | 0.5 | 0.5 | 0.5 | 0.5 | 0.5 | 0.6 | 1.0 | 0.5 |
| Organic peroxide (2) | | | | | | | | | | 0.6 | | |
| Propylene glycol | 1.5 | 1.0 | 1.5 | 1.5 | 1.5 | 1.5 | 1.5 | 1.5 | 1.5 | | | 1.5 |
| Water | | | | | | | | | | | 1.0 | |
| Zinc stearate | | | | | | | | | | 5.0 | | |
| Antioxidant (1) | | | | | | | | | | 0.1 | 0.1 | |
| Antioxidant (2) | 0.5 | 0.5 | 0.5 | 0.5 | 0.5 | 0.5 | 0.5 | 0.5 | 0.5 | | | 0.5 |
| Barium sulfate | | | | | | | | | | 30.5 | 27.0 | |
| Zinc oxide | 29.2 | 30.2 | 29.7 | 28.8 | 29.2 | 29.2 | 28.8 | 28.3 | 28.8 | 4.0 | 4.0 | 21.6 |
| Zinc salt of pentachlorothiophenol | 1.0 | 1.0 | 1.0 | 1.0 | 1.0 | 1.0 | 1.0 | 1.0 | 1.0 | | 0.3 | 1.0 |

Details on the ingredients mentioned in Table 1 are given below.

Polybutadiene A: Available under the trade name "BR 01" from JSR Corporation

Polybutadiene B: Available under the trade name "BR 730" from JSR Corporation

Zinc acrylate (1): "ZN-DA85S" from Nippon Shokubai Co., Ltd.

Zinc acrylate (2): "Sanceler SR" from Sanshin Chemical Industry Co., Ltd.

Organic peroxide (1): Dicumyl peroxide, available under the trade name "Percumyl D" from NOF Corporation Organic peroxide (2): Mixture of 1,1-di(t-butylperoxy)cyclohexane and silica, available under the trade name "Perhexa C-40" from NOF Corporation Propylene glycol: A lower divalent alcohol (molecular weight, 76.1), from Hayashi Pure Chemical Ind., Ltd.

Water: Pure water (from Seiki Chemical Industrial Co., Ltd.)

Zinc stearate: Available as "Zinc Stearate G" from NOF Corporation

Antioxidant (1): 2,2'-Methylenebis(4-methyl-6-butylphenol), available under the trade name "Nocrac NS-6" from Ouchi Shinko Chemical Industry Co., Ltd.

Antioxidant (2): 2-Mercaptobenzimidazole, available under the trade name "Nocrac MB" from Ouchi Shinko Chemical Industry Co., Ltd.

Barium sulfate: Barite powder, available as "Barico #100" from Hakusui Tech

Zinc oxide: Available under the trade name "Zinc Oxide Grade 3" from Sakai Chemical Co., Ltd.

Zinc salt of pentachlorothiophenol:

Available from Wako Pure Chemical Industries, Ltd.

Formation of Envelope Layer and Intermediate Layer

Next, in each Example and Comparative Example other than Comparative Example 6, an envelope layer was formed by injection-molding the envelope layer material formulated as shown in Table 2 over the core, following which an intermediate layer was formed by injection-molding the intermediate layer material formulated as shown in the same table over the envelope layer, thereby giving a sphere encased by an envelope layer and an intermediate layer.

It is noted that in Example 2 and Comparative Examples 4, 5, the envelope layer material and the intermediate layer material shown in Table 2 are injection-molded as described above, thereby giving a sphere encased by an envelope layer and an intermediate layer. In Comparative Example 6, an intermediate layer material formulated as shown in Table 2 is injection-molded over the core to form an intermediate layer, thereby giving an intermediate layer-encased sphere.

Formation of Cover (Outermost Layer)

Next, in all of the Examples and Comparative Examples, a cover (outermost layer) was formed by injection-molding a cover material formulated as shown in Table 2 over the intermediate layer-encased sphere obtained in that Example. A plurality of given dimples common to all the Examples and Comparative Examples were formed at this time on the surface of the cover. It is noted that in Example 2 and Comparative Examples 4, 5, 6, the cover material shown in Table 2 are injection-molded. A plurality of given dimples common to the Example and Comparative Examples are formed at this time on the surface of the cover.

TABLE 2

| Content (pbw) | No. 1 | No. 2 | No. 3 | No. 4 | No. 5 | No. 6 | No. 7 | No. 8 |
|---|---|---|---|---|---|---|---|---|
| Hytrel 4001 | 100 | | | | | | | |
| Hytrel 3046 | | 100 | | | | | | |
| HPF 2000 | | | 100 | | | | | |
| HPF 1000 | | | | 100 | 56 | | | |
| Himilan 1605 | | | | | 44 | | | 50 |
| AM 7318 | | | | | | | 75 | |
| AM 7327 | | | | | | | 25 | |
| AM 7329 | | | | | | | | 50 |
| Surlyn 9320 | | | | | | 70 | | |
| AN 4221C | | | | | | 30 | | |
| Magnesium stearate | | | | | | 60 | | |
| Magnesium oxide | | | | | | 1.12 | | |
| Titanium oxide | | | | | | | 4 | 4 |

Trade names of the materials in the above table are given below.

Hytrel 4001, Hytrel 3046:

Polyester elastomers available from DuPont-Toray Co., Ltd.

HPF 1000: An ionomer available from The Dow Company, Inc.

HPF 2000: An ionomer available from The Dow Company, Inc.

Himilan 1605, AM 7318, AM 7327, AM 7329:

Ionomers available from Dow-Mitsui Polychemicals Co., Ltd.

Surlyn 9320: An ionomer available from The Dow Company, Inc.

AN 4221C: Available as "Nucrel" from Dow-Mitsui Polychemicals Co., Ltd.

Magnesium stearate: Available as "Magnesium Stearate G" from NOF Corporation

Magnesium oxide: Available as "Kyowamag MF-150" from Kyowa Chemical Industry Co., Ltd.

Titanium oxide: Available from Sakai Chemical Industry Co., Ltd.

Figure 2A:
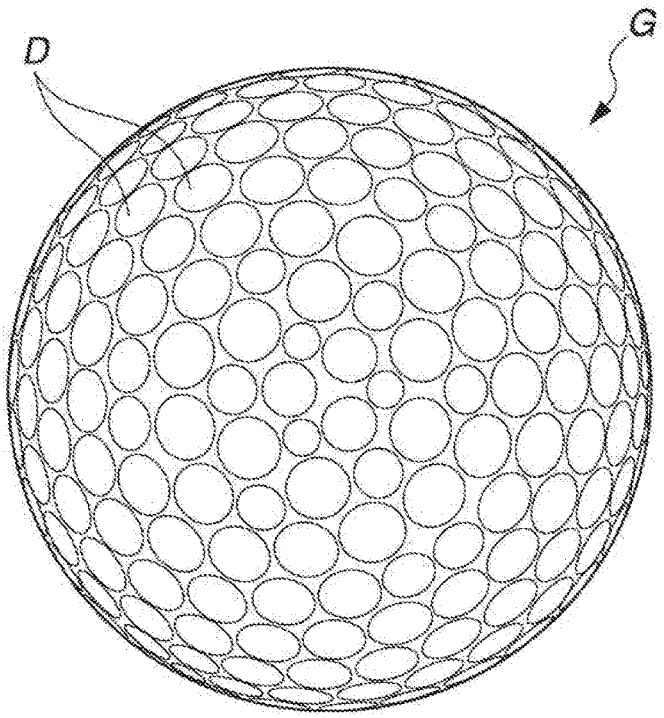
FIG. 2A and FIG. 2B show diagrams of the dimple arrangement common to all the Examples and Comparative Examples, FIG. 2A being a plan view and FIG. 2B being a side view.
Figure 2B:
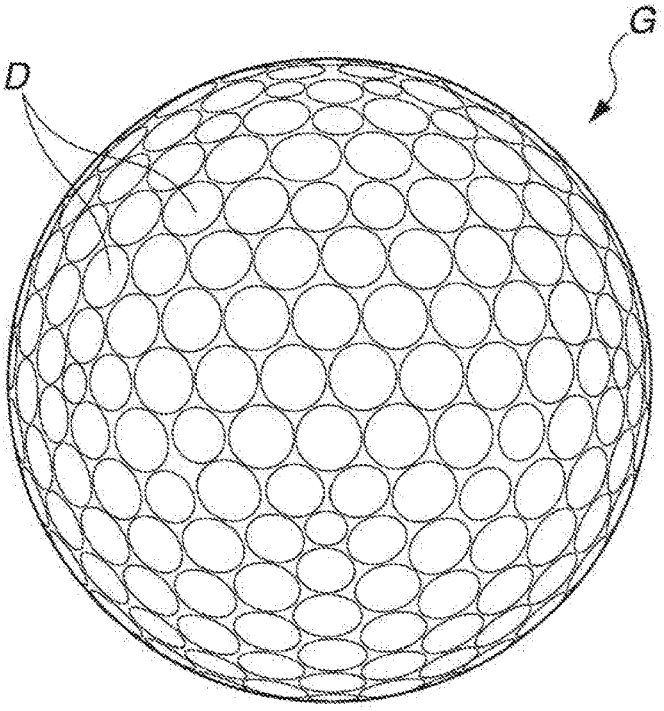

Eight types of circular dimples were used. The dimples and the dimple arrangement were common to all of the Examples and Comparative Examples. Details on the dimples are shown in Table 3 below, and the dimple arrangement is shown in FIG. 2A and FIG. 2B.

TABLE 3

| Dimple A | Number | Diameter (mm) | Depth (mm) | Volume ($mm^2$) | Cylinder volume ratio | SR (%) | VR (%) |
|---|---|---|---|---|---|---|---|
| A-1 | 12 | 4.6 | 0.118 | 1.111 | 0.566 | 82.3 | 0.77 |
| A-2 | 198 | 4.45 | 0.117 | 1.031 | 0.566 | | |
| A-3 | 36 | 3.85 | 0.114 | 0.752 | 0.566 | | |
| A-4 | 12 | 2.75 | 0.085 | 0.286 | 0.566 | | |
| A-5 | 36 | 4.45 | 0.126 | 1.110 | 0.566 | | |
| A-6 | 24 | 3.85 | 0.123 | 0.811 | 0.566 | | |
| A-7 | 6 | 3.4 | 0.115 | 0.558 | 0.534 | | |
| A-8 | 6 | 3.3 | 0.115 | 0.526 | 0.534 | | |
| Total | 330 | | | | | | |

Dimple Definitions

Edge: Highest place in cross-section passing through center of dimple.

Diameter: Diameter of flat plane circumscribed by edge of dimple.

Depth: Maximum depth of dimple from flat plane circumscribed by edge of dimple.

SR: Sum of individual dimple surface areas, each defined by flat plane circumscribed by edge of dimple, as a percentage of spherical surface area of ball were it to have no dimples thereon.

Dimple volume:

Dimple volume below flat plane circumscribed by edge of dimple.

Cylinder volume ratio:

Ratio of dimple volume to volume of cylinder having same diameter and depth as dimple.

VR: Sum of volumes of individual dimples formed below flat plane circumscribed by edge of dimple, as a percentage of volume of ball sphere were it to have no dimples thereon.

Formation of Coating Layer

Next, the coating composition shown in Table 4 below was applied with an air spray gun onto the surface of the cover (outermost layer) on which numerous dimples had been formed, thereby producing golf balls having a 15 μm-thick coating layer formed thereon.

It is noted that in Example 2 and Comparative Examples 4, 5, 6, the coating composition shown in Table 4 below is applied with an air spray gun onto the surface of the cover as described above, thereby producing golf balls having a 15 μm-thick coating layer formed thereon.

TABLE 4

| | | | |
|---|---|---|---|
| Coating composition C (pbw) | Base resin | Polyol | 29.77 |
| | | Additive | 0.22 |
| | | Solvent | 70.01 |
| | Curing agent | Isocyanate | 42 |
| | | Solvent | 58 |
| Coat properties | Shore C hardness | | 63 |
| | Thickness (μm) | | 15 |

A polyester polyol synthesized as follows was used as the polyol in the base resin.

A reactor equipped with a reflux condenser, a dropping funnel, a gas inlet and a thermometer was charged with 140 parts by weight of trimethylolpropane, 95 parts by weight of ethylene glycol, 157 parts by weight of adipic acid and 58 parts by weight of 1,4-cyclohexanedimethanol, following which the temperature was raised to between 200 and 240° C. under stirring and the reaction was effected by 5 hours of heating. This yielded a polyester polyol having an acid value of 4, a hydroxyl value of 170 and a weight-average molecular weight (Mw) of 28,000. The additive was a water-repellent additive. All the additives used were commercial products. Products that were silicone-based additives, stain resistance-improving silicone additives, or fluoropolymers having an alkyl group chain length of 7 or less were added.

The isocyanate used in the curing agent was Duranate™ TPA-100 (from Asahi Kasei Corporation; NCO content, 23.1%; 100% nonvolatiles), which is an isocyanurate of hexamethylene diisocyanate (HMDI).

Butyl acetate was used as the base resin solvent, and ethyl acetate and butyl acetate were used as the curing agent solvents. The Shore C hardness value in the table was obtained by preparing sheets having a thickness of 2 mm, stacking together three of the sheets, and carrying out measurement with a Shore C durometer in accordance with ASTM D2240.

Various properties of the resulting golf balls, including the core center and surface hardnesses and the hardness at a given position in the core, the diameters of the core and the respective layer-encased spheres, the thickness and material hardness of each layer, and the surface hardnesses and compressive deformations under given loading of the respective layer-encased spheres, were evaluated by the following methods. It is noted that in Example 2 and Comparative Examples 4, 5, 6, the above properties of the golf ball are evaluated by the following methods. The results are presented in Table 5.

Diameters of Core, Envelope Layer-Encased Sphere and Intermediate Layer-Encased Sphere The diameters at five random places on the surface were measured at a temperature of 23.9±1° C. and, using the average of these measurements as the measured value for a single core, envelope layer-encased sphere or intermediate layer-encased sphere, the average diameter for ten such spheres was determined.

Ball Diameter

The diameters at 15 random dimple-free areas were measured at a temperature of 23.9±1° C. and, using the average of these measurements as the measured value for a single ball, the average diameter for ten balls was determined.

Compressive Deformations of Core, Envelope Layer-Encased Sphere, Intermediate Layer-Encased Sphere and Ball The sphere to be measured was placed on a hard plate and the following compressive deformations for each type of sphere were measured: for the core, the compressive deformation P when subjected to a final load of 130 kgf from an initial load state of 10 kgf; for the envelope layer-encased sphere, the compressive deformation Q when subjected to a final load of 130 kgf from an initial load state of 10 kgf; for the intermediate layer-encased sphere, the compressive deformation R when subjected to a final load of 130 kgf from an initial load state of 10 kgf; and for the ball, the compressive deformation A when subjected to a final load of 5 kgf from an initial load state of 0.2 kgf, the compressive deformation B when subjected to a final load of 30 kgf from an initial load state of 5 kgf, the compressive deformation C when subjected to a final load of 60 kgf from an initial load state of 5 kgf and the compressive deformation D when subjected to a final load of 130 kgf from an initial load state of 10 kgf. These compressive deformations refer in each case to measured values obtained after holding the sphere isothermally at 23.9° C. The instrument used was a high-load compression tester available from MU Instruments Trading Corporation. Measurement was carried out with the pressing head moving downward at a speed of 4.7 mm/s.

Core Hardness Profile

The indenter of a durometer was set substantially perpendicular to the spherical surface of the core, and the core surface hardness on the Shore C hardness scale was measured in accordance with ASTM D2240. The hardnesses at the center and specific positions of the core were measured as Shore C hardness values by perpendicularly pressing the indenter of a durometer against the center portion and the specific positions shown in Table 5 in the flat cross-section obtained by cutting the core into hemispheres. The P2 Automatic Rubber Hardness Tester (Kobunshi Keiki Co., Ltd.) equipped with a Shore C durometer was used for measuring the hardness. The maximum value was read off as the hardness value. Measurements were all carried out in a 23±2° C. environment.

Material Hardnesses (Shore D Hardnesses) of Envelope Layer, Intermediate Layer and Cover The resin materials for each of these layers were molded into sheets having a thickness of 2 mm and left to stand for at least two weeks. The Shore D hardness of each material was measured using a Shore D durometer in accordance with ASTM D2240. The P2 Automatic Rubber Hardness Tester (Kobunshi Keiki Co., Ltd.) on which a Shore D durometer had been mounted was used for measuring the hardness. The maximum value was read off as the hardness value. Measurements were all carried out in a 23±2° C. environment.

Surface Hardnesses (Shore D Hardnesses) of Envelope Layer-Encased Sphere, Intermediate Layer-Encased Sphere and Ball The surface hardnesses were measured by perpendicularly pressing an indenter against the surfaces of the respective spheres. The surface hardness of a ball (cover) was the value measured at a dimple-free area (land) on the surface of the ball. The Shore D hardness was measured using a Shore D durometer in accordance with ASTM D2240. The P2 Automatic Rubber Hardness Test (Kobunshi Keiki Co., Ltd.) on which a Shore D durometer had been mounted was used for measuring the hardness. The maximum value was read off as the hardness value. Measurements were all carried out in a 23±2° C. environment.

TABLE 5

| | | | Example | | | | | | Comparative Example |
|---|---|---|---|---|---|---|---|---|---|
| | | | 1 | 2 | 3 | 4 | 5 | 6 | 1 |
| Core | Diameter | mm | 35.17 | 35.17 | 35.18 | 35.23 | 35.17 | 35.17 | 35.23 |
| | Weight | g | 27.8 | 27.8 | 27.8 | 27.9 | 27.8 | 27.8 | 27.9 |
| | Compressive Deformation P | mm | 4.43 | 4.43 | 4.59 | 4.22 | 4.43 | 4.43 | 4.22 |
| | Surface hardness (Cs) | Shore C | 74.3 | 73.4 | 73.1 | 75.6 | 74.3 | 74.3 | 75.6 |
| | Hardness 3 mm inside surface (Cs-3) | Shore C | 71.7 | 71.6 | 70.5 | 72.9 | 71.7 | 71.7 | 72.9 |
| | Center hardness (Cc) | Shore C | 52.8 | 53.2 | 52.0 | 53.5 | 52.8 | 52.8 | 53.5 |
| | Surface hardness − Center hardness (Cs − Cc) | Shore C | 21.6 | 20.2 | 21.0 | 22.1 | 21.6 | 21.6 | 22.1 |
| | Cs − Cs-3 | Shore C | 2.6 | 1.8 | 2.6 | 2.7 | 2.6 | 2.6 | 2.7 |
| | Surface hardness (Cs) | Shore D | 41.5 | 40.8 | 40.5 | 42.5 | 41.5 | 41.5 | 42.5 |
| | Center hardness (Cc) | Shore D | 30.1 | 30.3 | 29.7 | 30.5 | 30.1 | 30.1 | 30.5 |
| | Surface hardness − Center hardness (Cs − Cc) | Shore D | 11.4 | 10.5 | 10.9 | 12.0 | 11.4 | 11.4 | 12.0 |
| Envelope layer | Type | | No. 1 | No. 1 | No. 1 | No. 2 | No. 2 | No. 2 | No. 1 |
| | Thickness | mm | 1.24 | 1.24 | 1.24 | 1.22 | 1.25 | 1.25 | 1.21 |
| | Material hardness | Shore D | 40 | 40 | 40 | 27 | 27 | 27 | 40 |
| Envelope layer-encased sphere | Diameter | mm | 37.65 | 37.65 | 37.66 | 37.67 | 37.67 | 37.67 | 37.65 |
| | Weight | g | 33.6 | 33.6 | 33.7 | 33.6 | 33.5 | 33.5 | 33.7 |
| | Compressive Deformation Q | mm | 4.05 | 4.05 | 4.30 | 3.90 | 4.12 | 4.12 | 3.86 |
| | Surface hardness | Shore D | 46 | 46 | 46 | 41 | 41 | 41 | 46 |
| Envelope layer surface hardness − Core center hardness | | Shore D | 16 | 16 | 16 | 11 | 11 | 11 | 16 |
| Envelope layer surface hardness − Core surface hardness | | Shore D | 5 | 5 | 5 | −1 | 0 | 0 | 4 |
| Difference between 10-130 kgf compressive deformations (P-Q) | | mm | 0.38 | 0.38 | 0.29 | 0.33 | 0.31 | 0.31 | 0.36 |
| Intermediate layer | Type | | No. 5 | No. 5 | No. 5 | No. 5 | No. 5 | No. 6 | No. 5 |
| | Weight | mm | 1.31 | 1.31 | 1.30 | 1.29 | 1.30 | 1.28 | 1.31 |
| | Material hardness | Shore D | 57 | 57 | 57 | 57 | 57 | 52 | 57 |
| Intermediate layer-encased sphere | Diameter | mm | 40.27 | 40.27 | 40.27 | 40.26 | 40.28 | 40.24 | 40.28 |
| | Weight | g | 39.6 | 39.6 | 39.5 | 39.3 | 39.4 | 39.4 | 39.6 |
| | Compressive Deformation R | mm | 3.61 | 3.61 | 3.78 | 3.58 | 3.76 | 3.76 | 3.44 |
| | Surface hardness | Shore D | 63 | 63 | 63 | 63 | 63 | 60 | 63 |

TABLE 5-continued

| | | | | | | | | | |
|---|---|---|---|---|---|---|---|---|---|
| Intermediate layer surface hardness – Envelope layer surface hardness | | Shore D | 17 | 17 | 17 | 22 | 22 | 19 | 17 |
| Difference between 10-130 kgf compressive deformations (Q-R) | | mm | 0.44 | 0.44 | 0.52 | 0.32 | 0.36 | 0.37 | 0.42 |
| Cover | Type | | No. 7 | No. 7 | No. 7 | No. 7 | No. 7 | No. 7 | No. 7 |
| | Thickness | mm | 1.23 | 1.23 | 1.22 | 1.23 | 1.22 | 1.25 | 1.22 |
| | Material hardness | Shore C | 92 | 92 | 92 | 92 | 92 | 92 | 92 |
| | | Shore D | 62 | 62 | 62 | 62 | 62 | 62 | 62 |
| Coat | Type | | Coating C | Coating C | Coating C | Coating C | Coating C | Coating C | Coating C |
| | Material hardness | Shore C | 63 | 63 | 63 | 63 | 63 | 63 | 63 |
| Cover material hardness – Coating material hardness | | Shore C | 29 | 29 | 29 | 29 | 29 | 29 | 29 |
| Ball | Diameter | mm | 42.73 | 42.73 | 42.72 | 42.72 | 42.72 | 42.73 | 42.72 |
| | Weight | g | 45.6 | 45.6 | 45.5 | 45.4 | 45.4 | 45.5 | 45.6 |
| | Compressive Deformation A, 0.2-5 kgf | mm | 0.17 | 0.17 | 0.16 | 0.13 | 0.17 | 0.14 | 0.16 |
| | Compressive Deformation B, 5-30 kgf | mm | 0.74 | 0.74 | 0.78 | 0.75 | 0.84 | 0.86 | 0.71 |
| | Compressive Deformation C, 05-60 kgf | mm | 1.58 | 1.59 | 1.68 | 1.66 | 1.72 | 1.81 | 1.53 |
| | Compressive Deformation D, 10-130 kgf | mm | 2.98 | 2.99 | 3.12 | 3.01 | 3.10 | 3.24 | 2.89 |
| | Surface hardness | Shore D | 68 | 68 | 68 | 68 | 68 | 68 | 68 |
| Cover surface hardness – Ball surface hardness | | Shore D | −27 | −27 | −27 | −26 | −27 | −27 | −26 |
| Ball surface hardness – Intermediate layer surface hardness | | Shore D | 5 | 5 | 5 | 5 | 5 | 8 | 5 |
| Difference between 10-130 kgf compressive deformations (P-A) | | mm | 1.45 | 1.44 | 1.47 | 1.22 | 1.33 | 1.18 | 1.33 |
| Compressive deformation ratio D/C | | | 1.89 | 1.88 | 1.86 | 1.81 | 1.80 | 1.79 | 1.89 |
| Compressive deformation ratio D/B | | | 4.03 | 4.04 | 4.02 | 4.00 | 3.69 | 3.75 | 4.08 |
| Compressive deformation ratio D/A | | | 17.5 | 17.6 | 19.8 | 22.8 | 18.7 | 23.5 | 18.5 |

| | | | | Comparative Example | | | | |
|---|---|---|---|---|---|---|---|---|
| | | | | 2 | 3 | 4 | 5 | 6 |
| | Core | Diameter | mm | 35.18 | 35.23 | 35.23 | 35.23 | 37.29 |
| | | Weight | g | 27.8 | 27.9 | 27.9 | 27.9 | 32.6 |
| | | Compressive Deformation P | mm | 4.01 | 4.22 | 4.22 | 4.20 | 3.19 |
| | | Surface hardness (Cs) | Shore C | 76.9 | 75.6 | 73.7 | 84.3 | 81.4 |
| | | Hardness 3 mm inside surface (Cs-3) | Shore C | 74.1 | 72.9 | 68.7 | 77.9 | 79.1 |
| | | Center hardness (Cc) | Shore C | 54.3 | 53.5 | 58.5 | 57.2 | 57.5 |
| | | Surface hardness – Center hardness (Cs – Cc) | Shore C | 22.6 | 22.1 | 15.2 | 27.1 | 23.9 |
| | | Cs – Cs-3 | Shore C | 2.7 | 2.7 | 5.0 | 6.4 | 2.3 |
| | | Surface hardness (Cs) | Shore D | 43.4 | 42.5 | 41.0 | 49.1 | 46.9 |
| | | Center hardness (Cc) | Shore D | 30.8 | 30.5 | 33.1 | 32.4 | 32.5 |
| | | Surface hardness – Center hardness (Cs – Cc) | Shore D | 12.6 | 12.0 | 8.0 | 16.7 | 14.3 |
| | Envelope layer | Type | | No. 2 | No. 2 | No. 2 | No. 2 | — |
| | | Thickness | mm | 1.25 | 1.22 | 1.22 | 1.22 | — |
| | | Material hardness | Shore D | 27 | 27 | 27 | 27 | — |
| | Envelope layer-encased sphere | Diameter | mm | 37.68 | 37.67 | 37.67 | 37.67 | — |
| | | Weight | g | 33.6 | 33.6 | 33.6 | 33.6 | — |
| | | Compressive Deformation Q | mm | 3.68 | 3.90 | 3.90 | 3.90 | — |
| | | Surface hardness | Shore D | 41 | 41 | 41 | 41 | — |
| | Envelope layer surface hardness – Core center hardness | | Shore D | 10 | 11 | 8 | 9 | — |
| | Envelope layer surface hardness – Core surface hardness | | Shore D | −2 | −1 | 0 | −8 | — |
| | Difference between 10-130 kgf compressive deformations (P-Q) | | mm | 0.33 | 0.33 | 0.33 | 0.30 | — |
| | Intermediate layer | Type | | No. 3 | No. 3 | No. 5 | No. 5 | No.4 |
| | | Weight | mm | 1.29 | 1.29 | 1.29 | 1.29 | 1.36 |
| | | Material hardness | Shore D | 47 | 47 | 57 | 57 | 51 |

TABLE 5-continued

| | | | | | | | |
|---|---|---|---|---|---|---|---|
| Intermediate layer-encased sphere | Diameter | mm | 40.26 | 40.26 | 40.26 | 40.26 | 40.00 |
| | Weight | g | 39.4 | 39.4 | 39.3 | 39.3 | 38.7 |
| | Compressive Deformation R | mm | 3.49 | 3.71 | 3.58 | 3.58 | 3.01 |
| | Surface hardness | Shore D | 53 | 53 | 63 | 63 | 58 |
| Intermediate layer surface hardness – Envelope layer surface hardness | | Shore D | 12 | 12 | 22 | 22 | — |
| Difference between 10-130 kgf compressive deformations (Q-R) | | mm | 0.19 | 0.19 | 0.32 | 0.32 | — |
| Cover | Type | | No. 7 | No. 7 | No. 7 | No. 7 | No. 8 |
| | Thickness | mm | 1.23 | 1.23 | 1.23 | 1.23 | 1.34 |
| | Material hardness | Shore C | 92 | 92 | 92 | 92 | 95 |
| | | Shore D | 62 | 62 | 62 | 62 | 64 |
| Coat | Type | | Coating C | Coating C | Coating C | Coating C | Coating C |
| | Material hardness | Shore C | 63 | 63 | 63 | 63 | 63 |
| Cover material hardness – Coating material hardness | | Shore C | 29 | 29 | 29 | 29 | 32 |
| Ball | Diameter | mm | 42.73 | 42.73 | 42.72 | 42.72 | 42.67 |
| | Weight | g | 45.5 | 45.4 | 45.4 | 45.4 | 45.4 |
| | Compressive Deformation A, 0.2-5 kgf | mm | 0.17 | 0.18 | 0.13 | 0.13 | 0.13 |
| | Compressive Deformation B, 5-30 kgf | mm | 0.98 | 0.98 | 0.75 | 0.75 | 0.72 |
| | Compressive Deformation C, 05-60 kgf | mm | 1.86 | 1.93 | 1.66 | 1.66 | 1.40 |
| | Compressive Deformation D, 10-130 kgf | mm | 3.20 | 3.31 | 3.01 | 3.01 | 2.64 |
| | Surface hardness | Shore D | 68 | 68 | 68 | 68 | 71 |
| Cover surface hardness – Ball surface hardness | | Shore D | −25 | −26 | −27 | −19 | −24 |
| Ball surface hardness – Intermediate layer surface hardness | | Shore D | 15 | 15 | 5 | 5 | 13 |
| Difference between 10-130 kgf compressive deformations (P-A) | | mm | 0.81 | 0.92 | 1.22 | 1.19 | 0.56 |
| Compressive deformation ratio D/C | | | 1.72 | 1.72 | 1.81 | 1.81 | 1.88 |
| Compressive deformation ratio D/B | | | 3.27 | 3.37 | 4.00 | 4.00 | 3.64 |
| Compressive deformation ratio D/A | | | 18.4 | 18.8 | 22.8 | 22.8 | 20.9 |

The flight performance, feel at impact and durability to cracking of each of the golf balls were evaluated by the following methods. It is noted that in Example 2 and Comparative Examples 4, 5, 6, the flight performance, feel at impact and durability to cracking of each of the golf balls are evaluated by the following methods. The results are shown in Table 7.

Flight Performance

Various clubs (W #1, UT #4, I #6) were mounted on a golf swing robot and the distances traveled by the ball when struck under the conditions shown in Table 6 below were measured and then rated according to the criteria in the table.

TABLE 6

| | | W#1 | W#1 | UT#4 | I#6 |
|---|---|---|---|---|---|
| Club used | Product name | PHYZ | PHYZ | PHYZ | PHYZ |
| | Conditions | HS = 40 m/s | HS = 35 m/s | HS = 35 m/s | HS = 35 m/s |
| Rating criteria | Good | ≥205.0 m | ≥175.0 m | ≥160.0 m | ≥139.0 m |
| | NG | ≤204.9 m | ≤174.9 m | ≤159.9 m | ≤138.9 m |

The club name of "PHYZ" in the table refers to the following clubs that were used: the "PHYZ Driver" (loft angle, 10.5°), "PHYZ Utility U4" and "PHYZ Iron I #6," all manufactured by Bridgestone Sports Co., Ltd.

Feel

Sensory tests of the feel of the ball on shots with a driver (W #1) swung by an amateur user having a head speed of 30 to 40 m/s were carried out, and the "soft feel" and "solid feel" were both rated according to the following criteria.

(1) Criteria for Rating "Soft Feel"

Good: 12 or more of 20 golfers rated the ball as having a soft feel

Fair: From 7 to 11 of 20 golfers rated the ball as having a soft feel

NG: Six or fewer of 20 golfers rated the ball as having a soft feel (2) Criteria for Rating "Solid Feel"

Good: 12 or more of 20 golfers rated the ball as having a solid feel

Fair: From 7 to 11 of 20 golfers rated the ball as having a solid feel

NG: Six or fewer of 20 golfers rated the ball as having a solid feel

Durability to Cracking on Repeated Impact

Ten sample balls (N=10) from each Example were repeatedly struck with a driver (W #1) at a head speed of 45 m/s and the durability was rated as follows. The number of shots after which a ball began to crack was counted for each of the ten balls. Of these balls, the three balls having the lowest number of shots on cracking were selected and the average number of shots on cracking for the three balls was treated as the "number of shots on cracking" for that Example. Durability indexes were determined for each Example based on a durability index of 100 for the number of shots on cracking in Example 2.

Rating Criteria:

Good: Durability index was 90 or more

NG: Durability index was less than 90

TABLE 6

| | | | Example | | | | | | Comparative Example | | | | | |
|---|---|---|---|---|---|---|---|---|---|---|---|---|---|---|
| | | | 1 | 2 | 3 | 4 | 5 | 6 | 1 | 2 | 3 | 4 | 5 | 6 |
| Flight | W#1 HS = 40 m/s | Spin rate (rpm) | 2,877 | 2,916 | 2,820 | 2,848 | 2,807 | 2,724 | 2,901 | 2,764 | 2,738 | 2,895 | 2,805 | 2,708 |
| | | Total distance (m) | 206.3 | 205.2 | 205.5 | 205.2 | 206.0 | 205.3 | 205.6 | 205.9 | 205.2 | 205.0 | 205.4 | 206.0 |
| | | Rating | good | good | good | good | good | good | good | good | good | good | good | good |
| | W#1 HS = 35 m/s | Spin rate (rpm) | 3,017 | 3,058 | 2,939 | 3,046 | 2,954 | 2,918 | 3,082 | 2,901 | 2,871 | 3,097 | 2,986 | 2,895 |
| | | Total distance (m) | 176.7 | 176.4 | 177.1 | 176.5 | 177.2 | 175.6 | 176.9 | 177.2 | 177.7 | 176.3 | 176.8 | 175.9 |
| | | Rating | good | good | good | good | good | good | good | good | good | good | good | good |
| | UT#4 | Spin rate (rpm) | 4,518 | 4,607 | 4,483 | 4,573 | 4,501 | 4,443 | 4,613 | 4,535 | 4,455 | 4,745 | 4,422 | 4,075 |
| | | Total distance (m) | 161.4 | 160.9 | 161.9 | 160.6 | 161.2 | 161.0 | 160.8 | 158.9 | 159.4 | 160.4 | 161.0 | 159.0 |
| | | Rating | good | good | good | good | good | good | good | NG | NG | good | good | NG |
| | I#6 | Spin rate (rpm) | 5,041 | 5,140 | 4,947 | 5,202 | 5,054 | 5,106 | 5,120 | 5,417 | 5,146 | 5,398 | 5,028 | 5,339 |
| | | Total distance (m) | 140.2 | 139.2 | 140.5 | 139.4 | 139.6 | 139.2 | 138.4 | 137.2 | 138.8 | 138.2 | 140.6 | 139.6 |
| | | Rating | good | good | good | good | good | good | NG | NG | NG | NG | good | good |
| Feel | Soft feel | Rating | good | good | good | good | good | good | fair | good | good | good | good | NG |
| | Solid feel | Rating | good | good | good | good | good | fair | good | fair | fair | good | good | good |
| Durability to repeated impact | | Rating | good | good | good | good | good | good | good | good | good | good | NG | good |

As demonstrated by the results in Table 7, the golf balls of Comparative Examples 1 to 6 are inferior in the following respects to the golf balls according to the present invention that are obtained in the Examples.

In Comparative Example 1, the compressive deformation B of the ball when subjected to a final load of 30 kgf from an initial load state of 5 kgf was smaller than 0.72 mm and the compressive deformation C of the ball when subjected to a final load of 60 kgf from an initial load state of 5 kgf was smaller than 1.55 mm. As a result, the soft feel of the ball was inferior and the distance on shots with a number 6 iron (I #6) was poor.

In Comparative Example 2, the compressive deformation B of the ball when subjected to a final load of 30 kgf from an initial load state of 5 kgf is larger than 0.97 mm and the compressive deformation C of the ball when subjected to a final load of 60 kgf from an initial load state of 5 kgf is larger than 1.85 mm. As a result, the solid feel of the ball is inferior and the distances traveled on shots with a utility club and a I #6 are poor.

In Comparative Example 3, the compressive deformation B of the ball when subjected to a final load of 30 kgf from an initial load state of 5 kgf was larger than 0.97 mm and the compressive deformation C of the ball when subjected to a final load of 60 kgf from an initial load state of 5 kgf was larger than 1.85 mm. As a result, the solid feel of the ball was inferior and the distances traveled on shots with a utility club and a I #6 were poor.

In Comparative Example 4, the core surface hardness−core center hardness (Cs−Cc), expressed on the Shore C hardness scale, is smaller than 20 and so the spin rate on shots with a I #6 rise, resulting in a poor distance.

In Comparative Example 5, the value of (core surface hardness)−(hardness at position 3 mm inside core surface), i.e., the (Cs−Cs−3) value, expressed on the Shore C hardness scale, is larger than 5.0. As a result, the durability to repeated impact is poor.

In Comparative Example 6, the compressive deformation C of the ball when subjected to a final load of 60 kgf from an initial load of 5 kgf is smaller than 1.55 mm. As a result, the soft feel is inferior and the distance traveled by the ball on shots with a utility club is poor.

Japanese Patent Application No. 2019-220909 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A golf ball comprising a core and a cover, wherein the ball has an amount of compressive deformation such that the compressive deformation B when the ball is subjected to a final load of 30 kgf from an initial load state of 5 kgf is from 0.72 to 0.97 mm and the compressive deformation C when the ball is subjected to a final load of 60 kgf from an initial load state of 5 kgf is from 1.55 to 1.85 mm, and the core has a hardness profile which, letting Cs be the Shore C hardness at a surface of the core, Cs−3 be the Shore C hardness at a position 3 mm inside the core surface and Cc be the Shore C hardness at a center of the core, satisfies formulas (1) and (2) below $$Cs-Cc \geq 20 \quad (1)$$

$$Cs-Cs-35.0 \quad (2)$$

and wherein the core is formed of a rubber composition comprising:

(a) a base rubber, (b) a co-crosslinking agent which is an α,β-unsaturated carboxylic acid or a metal salt thereof or both, (c) a crosslinking initiator, and (d) a lower alcohol having a molecular weight of less than 200.

2. The golf ball of claim 1, wherein the ball has an amount of compressive deformation such that the ratio D/C between compressive deformation C and the compressive deformation D when the ball is subjected to a final load of 130 kgf from an initial load state of 10 kgf is from 1.75 to 2.00.

3. The golf ball of claim 1, wherein the ball has an amount of compressive deformation such that the ratio D/A between the compressive deformation D when the ball is subjected to a final load of 130 kgf from an initial load state of 10 kgf and the compressive deformation A when the ball is subjected to a final load of 5 kgf from an initial load state of 0.2 kgf is from 16.0 to 25.0.

4. The golf ball of claim 1, wherein the content of component (d) is from 0.5 to 5 parts by weight per 100 parts by weight of the base rubber (a).

5. The golf ball of claim 1, wherein component (d) is a monohydric, dihydric or trihydric alcohol.

6. The golf ball of claim 1, wherein component (d) is butanol, glycerol, ethylene glycol or propylene glycol.

7. The golf ball of claim 1, wherein the ball further comprises, between the core and the cover, at least an envelope layer and an intermediate layer, and has a construction of four or more layers that includes the core, the envelope layer, the intermediate layer and the cover.

8. The golf ball of claim 1, wherein the cover has a coat formed on a surface thereof, which coat has a material hardness on the Shore C hardness scale of from 40 to 80.

* * * * *